United States Patent [19]

Nakagawa et al.

[11] 4,429,668

[45] Feb. 7, 1984

[54] INTERNAL COMBUSTION ENGINE FOR PORTABLE MACHINE

[75] Inventors: Kumaichi Nakagawa, Kokubunji; Hisashi Inaga, Tokyo, both of Japan

[73] Assignee: Kioritz Corporation, Tokyo, Japan

[21] Appl. No.: 418,155

[22] Filed: Sep. 15, 1982

[30] Foreign Application Priority Data

Oct. 20, 1981 [JP] Japan ..... 56-156204[U]

[51] Int. Cl.[3] ..... F02B 75/24

[52] U.S. Cl. ..... 123/56 B; 123/56 R; 123/56 A; 123/56 BA; 123/73 A

[58] Field of Search ..... 123/56 BC, 56 BA, 56 B, 123/56 BB, 56 C, 56 R, 56 A, 56 AA, 56 AB, 56 AC, 73 A, 74 R

[56] References Cited

U.S. PATENT DOCUMENTS

| | | | |
|---|---|---|---|
| Re. 26,222 | 6/1967 | Fielder | 123/56 BC |
| 1,278,585 | 9/1918 | Buehner | 123/56 BC |
| 1,316,437 | 9/1919 | Flood | 123/56 BC |
| 1,424,705 | 8/1922 | Abell | 123/56 AC |
| 1,733,361 | 10/1929 | Rice, Jr. | 123/56 BC |
| 1,814,333 | 7/1931 | Parker | 123/56 BC |
| 2,234,455 | 3/1941 | Smith | 123/56 BC |

FOREIGN PATENT DOCUMENTS

| | | | |
|---|---|---|---|
| 444382 | 8/1912 | France | 123/56 BC |
| 811149 | 1/1937 | France | 123/56 BC |
| 1137080 | 1/1957 | France | 123/56 BC |
| 56-81126 | 7/1981 | Japan . | |
| 241433 | 7/1946 | Switzerland | 123/56 BA |
| 238521 | 2/1926 | United Kingdom | 123/56 BA |

*Primary Examiner*—Wendell E. Burns

*Attorney, Agent, or Firm*—Karl W. Flocks; Sheridan Neimark

[57] ABSTRACT

A 2-cycle opposed cylinder internal combustion engine of simultaneous ignition type for portable machines such as grass trimmer. Two cylinders are provided at their same sides with intake ports and exhaust ports. In each cylinder, the intake pot and the exhaust port are arranged in a side-by-side relation in the direction of axis of the cylinder. Namely, exhaust port which is heated to high temperature is arranged near the intake port which is cooled during the operation of the engine. In consequence, the temperature of the portion around the exhaust port is lowered while the temperature of the portion around the intake port is raised to uniformalize the temperature distribution in the cylinder to eliminate various problems attributable to non-uniform temperature distribution in the cylinder.

1 Claim, 3 Drawing Figures

INTERNAL COMBUSTION ENGINE FOR PORTABLE MACHINE

BACKGROUND OF THE INVENTION

The present invention relates to a 2-cycle opposed cylinder internal combustion engine of simultaneous ignition type, suitable for use in a portable machine.

It is a current tendency to use a small-sized internal combustion engine in place of an electric motor as the power source for portable machine, partly because the engine has no electric cord which is troublesome to handle and partly because the engine can produce a large output power. The utility of such internal combustion engines will be further increased if the fundamental drawbacks, i.e. large noise and vibration, are eliminated.

SUMMARY OF THE INVENTION

Accordingly, it is a primary object of the invention to provide an internal combustion engine suitable for use in portable machines, improved to reduce the level of vibration and noise, as well as equalization and reduction of cylinder temperatures, thereby to achieve an improvement in charging efficiency and, hence, an increase of the engine output power.

To this end, according to the invention, there is provided a 2-cycle opposed cylinder simultaneous ignition type internal combustion engine comprising: a crank case; an intake system provided at the upper side of the crank case and including a carburetor, air cleaner and so forth; a fuel tank arranged around the intake system; a manifold type exhaust muffler provided at the lower side of the crank case; a starter provided on one end of the crank case in the axial direction of the crank shaft; a transmission shaft for working machine detachably connected to the output side of the crank shaft; and internally cooled type pistons received by cylinders acting as piston valves; each of the cylinders having an intake port and an exhaust port which are arranged on the same side of the cylinder in a side-by-side relation in the direction of axis of the cylinder.

More specifically, according to the invention, the intake and exhaust ports of each cylinder of the internal combustion engine for portable machines are arranged at the same side of the cylinder in a side-by-side relation to each other in the axial direction to achieve the following advantages.

(1) Uniformalization of Cylinder Temperature

Generally, in 2-cycle engines, each cylinder exhibits quite a complicated temperature distribution because ports such as scavenging ports, intake port and exhaust port are arranged in quite a complicated form. This complicated temperature distribution undesirably causes a thermal distortion of the cylinder resulting in various troubles such as local wear of the cylinder and piston or, in the case, a seizure of the piston. The distortion of the cylinder, even if it does not develop into fatal accident, causes various troubles such as loss of power due to leakage of gas, sticking of the piston ring and so forth. To obviate this problem, according to the invention, the intake port and the exhaust port are arranged in one side of the cylinder in a side-by-side relation. More specifically, exhaust ports of high temperature are arranged around the low temperature intake ports so that the temperature around the exhaust ports is lowered while the temperature around the intake ports is increased. These effects serve to equalize the temperature around the intake and exhaust ports, to realize a uniform temperature distribution which could not be achieved by the conventional engines. In consequence, the undesirable thermal distortion of the cylinder and, hence, various troubles attributable to the distortion are avoided to ensure a higher charging efficiency and increase of the output power derived from the engine.

(2) By combining an internally cooled piston with the cylinder stated above, the excessive rise of piston temperature is avoided while the cylinder is cooled from the inner side thereof. The exchange of heat between the piston and the cylinder is made also through the air-fuel mixture flowing in the combustion chamber. This heat exchange promotes the vaporization of the fuel droplets in the air-fuel mixture thereby to contribute to the improvement in the combustion. This effect is remarkable particularly in small-sized 2-cycle internal combustion engines of the kind described.

(3) The arrangement in accordance with the invention contributes also to an suppression of vibration.

Hitherto, single cylinder engines having only one cylinder have been used as the power source of various portable machines, and it has been out of consideration to use opposed cylinder engines for such purpose. The small-sized internal combustion engine in accordance with the invention has substantially symmetrical arrangement of two cylinders in every aspects of combustion cycle, reciprocatable parts and rotary parts, so that the vibrating energies in movable parts are negated by each other to remarkably suppress the generation of vibration. This effect is remarkable particularly in the small-sized internal combustion engines.

Thus, the present invention offers various advantages such as an increase in the engine output and enhanced reliability thanks to the uniformalization of the cylinder temperature, as well as remarkable vibration suppressing effect which owes to the use of 2-cycle opposed cylinder engine of simultaneous ignition type. Furthermore, it is possible to suppress the exhaust noise by the use of a maniforld type muffler which provides an ample muffling volume.

BRIEF DESCRIPTION OF THE DRAWINGS

The accompanying drawings in combination show a preferred embodiment of the invention in which.

DESCRIPTION OF THE PREFERRED EMBODIMENTS

A preferred embodiment of the invention will be described hereinunder with reference to the accompanying drawings.

Figure 1:
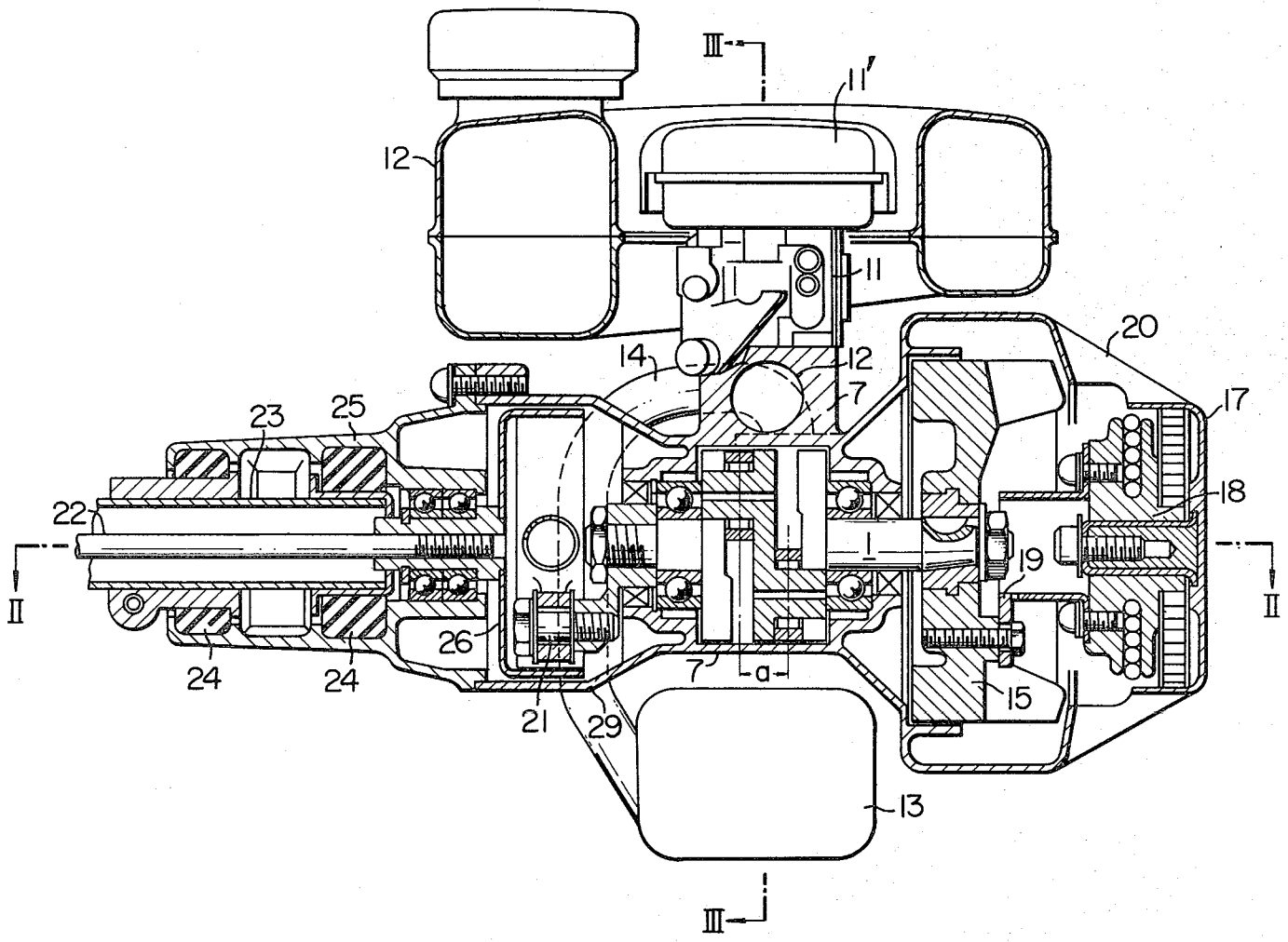
FIG. 1 is a vertical sectional view of an internal combustion engine in accordance with an embodiment of the invention suitable for a portable grass trimmer.
Figure 2:
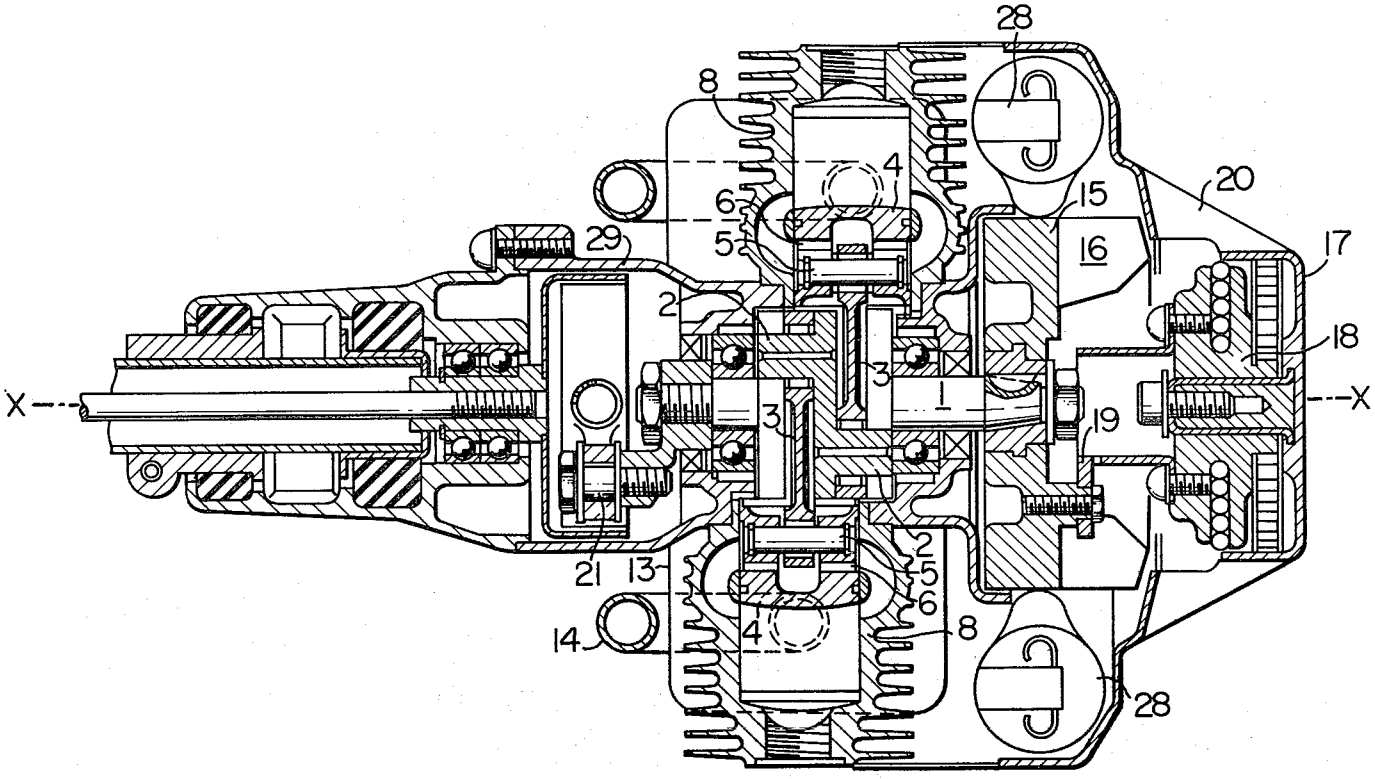
FIG. 2 is a cross-sectional view taken along the line II—II of FIG. 1.
Figure 3:
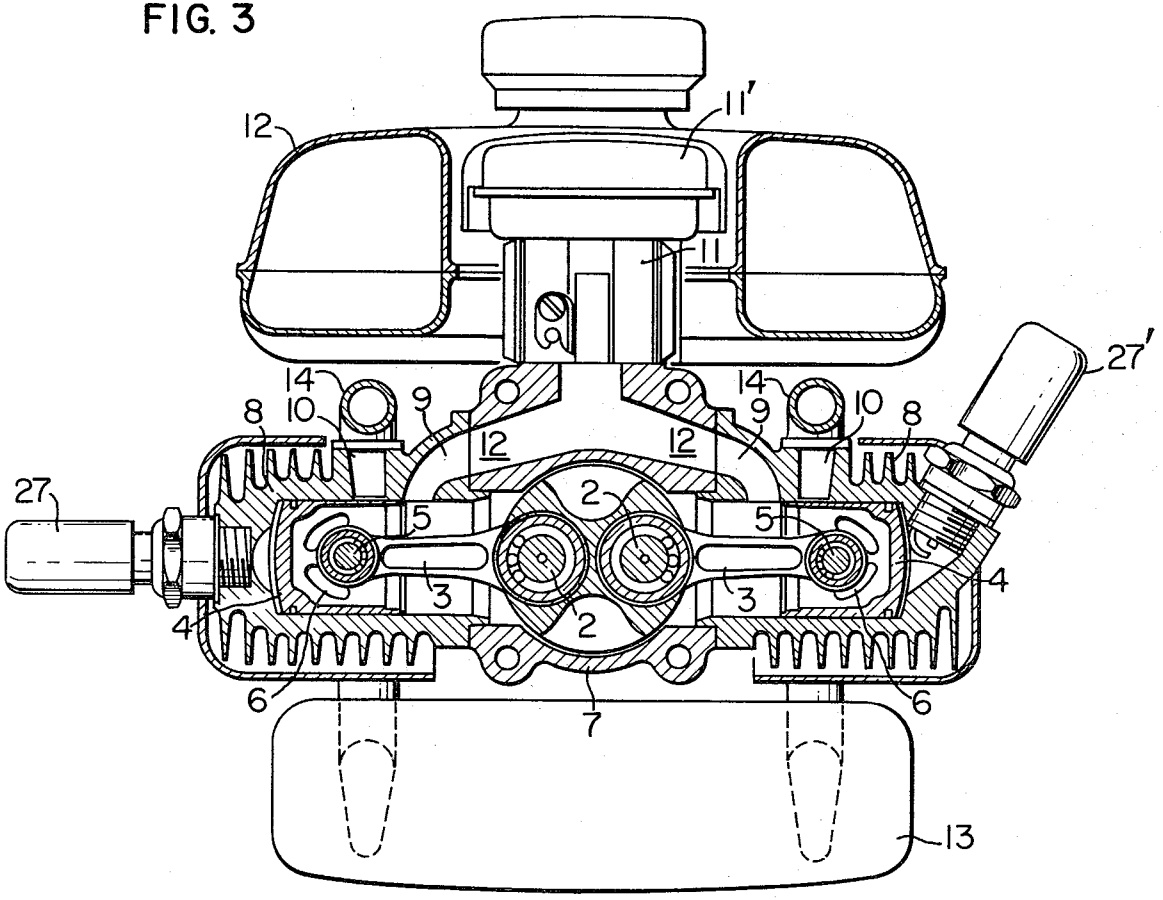
FIG. 3 is a cross-sectional view taken along the line III—III of FIG. 1.

Referring to FIG. 2, an internal combustion engine constructed in accordance with an embodiment of the invention has two cylinders 8,8 which are arranged horizontally to extend in opposite directions from the axis X-X of a common crank shaft 1. These cylinders 8,8 receive pistons 4,4 which are conected to the common crank shaft 1 at a phase difference of 180° in crank angle, with a slight offset $\alpha$. Since there is a phase difference of 180° between two cylinders 8,8 this 2-cycle engine can operate by simultaneous ignition in two cylinders. The pistons 4,4 are connected to crank pins 2,2 through connecting rods 3,3. The pistons 4,4 are provided with passage ports 6,6 for air-fuel mixture formed at portions thereof near respective piston pins 5,5. Combustion chambers of the cylinders 8,8 are communicated with the interior of a crank cases 7 through these passage ports 6,6 so that air-fuel mixture is allowed to pass through these passage ports 6,6 in the scavenging and intake stroke. As will be seen from FIG. 3, in each of the cylinders 8,8 arranged to oppose to each other in the horizontal direction, an intake port 9 and an exhaust port 10 are arranged in a side-by-side relation in the direction of axis of the cylinder 8, at the upper side of the cylinder 8. An intake system including a carburetor 11 is provided at the upper side of the crank case 7. More specifically, the carburetor 11 with an air-filter 11' is positioned above the crank case 7 and is connected to the two opposing cylinders 8,8 through intake passages 12,12 formed in the upper side of the crank case 7. A fuel tank 12 having a substantially annular form is mounted to surround the carburetor 11. The carburetor 11 is connected to the tank 12 and throttle system (not shown) and associated parts through a strainer, a cock or the like.

As exhaust muffler 13 is disposed at the lower side of the crank case 7 and is connected to the exhaust ports 10,10 of respective cylinders 8,8 through exhaust pipes 14,14. Thus, the exhaust muffler 13 takes the form of a manifold type muffler. Although not shown, the muffler 13 has a suitable structure for suppressing the generation of noise produced by the exhaust gas flowing therethrough.

A fly-wheel magneto rotor 15 provided with a fan 16 is connected to one end of the crank shaft 1. Electronic ignition devices 28,28 are arranged around the magneto rotor 15 to form an ignition system which in turn is covered by a housing cover 17. At the same time, a recoil starter 18 is provided on the cover 17 aligned with the axis X-X of the crank shaft 1. The recoil starter 18 is adapted to engage with a ratchet device 19 for rotating the crank shaft 1 thereby to start the engine.

The housing cover 17 is provided with openings 20 for the aforementioned fan 16. The openings 20 serve as the passage for ambient air for cooling the cylinders. The illustrated form of the passage of cooling air is not exclusive. For instance, insteadly of the aforementioned fan 16, it is possible to provide another fan at the connection between the engine and the working machine so as to such the air from the front side of the cylinders. In such a case, the cooling air flows in the direction opposite to that in the illustrated embodiment.

The crank case 7 is projected at the other axial end portion of the crank shaft 1 to form a clutch housing 29 accomodating a clutch device 21 for connection with various working machines. The drawings exemplarily show the essential part of couplig arrangement to the operation rod and transmission of a grass trimmer. Namely, an operation rod consisting of a transmission shaft 22 and an outer pipe 23 is connected through vibration dampers 24,24 to a connecting box 25 which in turn is fastened to the clutch housing 29. A clutch drum 26 is provided integrally with the end of the transmission shaft 22 so as to be selectively brought into and out of engagement with the centrifugal clutch device 21. In consequence, the torque from the engine is transmitted through the clutch device 21 and transmission shaft 22 to mowing blades (not shown) rotatably mounted on the other end of the operation rod thereby to drive the same. Although in the embodiment shown in FIG. 3 two sparking plugs 27,27' are arranged in an assymetry, this is not exclusive and two sparking plugs may be arranged in symmetry at an inclination to the axis of cylinders as in the case of the right-hand side cylinder 8 in FIG. 3 or in parallel with the cylinder axis as in the case of the left-hand side cylinder 8 in FIG. 3.

Although the invention has been described through specific terms, it is to be noted here that the described embodiment are not exclusive and various charges and modifications may be imparted thereto without departing from the scope of the invention which is limited solely by the appended claim.

What is claimed is:

1. A 2-cycle opposed cylinder simultaneous ignition type internal combustion engine comprising: a crank case 7; an intake system provided at the upper side of said crank case 7 and including a carburetor 11, air cleaner 11' and so forth; a fuel tank 12 arranged around said intake system; a manifold type exhaust muffler 13 provided at the lower side of said crank case 7; a starter 18 provided on one end of said crank case 7 in the axial direction of a crank shaft 1 of the engine; a transmission shaft 22 for working machine detachably connected to the output side of said crank shaft 1; and internally cooled type pistons 4,4 received by two cylinders 8,8 acting as piston valves; each of said cylinders 8,8 having an intake port 9 and an exhaust port 10 which are arranged on the same side of said cylinder 8 in a side-by-side relation in the direction of axis of said cylinder 8.

* * * * *